US009458571B2

(12) United States Patent
Laine et al.

(10) Patent No.: US 9,458,571 B2
(45) **Date of Patent: *Oct. 4, 2016**

(54) METHOD FOR PRODUCING FURNISH, FURNISH AND PAPER

(71) Applicant: UPM-KYMMENE CORPORATION, Helsinki (FI)

(72) Inventors: Janne Laine, Espoo (FI); Monika Österberg, Espoo (FI); Delphine Miquel, Houillles (FR); Leila Pohjola, Tervalampi (FI); Irmeli Sinisalo, Lappeenranta (FI); Harri Kosonen, Lappeenranta (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/573,939

(22) Filed: Dec. 17, 2014

(65) Prior Publication Data

US 2015/0101770 A1 Apr. 16, 2015

Related U.S. Application Data

(63) Continuation of application No. 13/318,246, filed as application No. PCT/FI2010/050350 on Apr. 29, 2010, now Pat. No. 8,945,345.

(30) Foreign Application Priority Data

Apr. 29, 2009 (FI) ..... 20095480

(51) Int. Cl.

| | |
|---|---|
| ***D21H 17/69*** | (2006.01) |
| ***D21H 11/18*** | (2006.01) |
| ***D21H 17/00*** | (2006.01) |
| *D21H 17/67* | (2006.01) |

(52) U.S. Cl.

CPC ..... *D21H 17/69* (2013.01); *D21H 11/18* (2013.01); *D21H 17/74* (2013.01); *D21H 17/67* (2013.01)

(58) Field of Classification Search

USPC ..... 162/9, 175, 181.2
IPC ..... D21H 17/69,17/74, 11/18; D21C 9/00
See application file for complete search history.

(56) References Cited

U.S. PATENT DOCUMENTS

| | | | | |
|---|---|---|---|---|
| 4,889,594 | A | 12/1989 | Gavelin | |
| 5,240,561 | A | 8/1993 | Kaliski | |
| 6,183,596 | B1 | 2/2001 | Matsuda et al. | |
| 6,235,150 | B1 | 5/2001 | Middleton et al. | |
| 8,945,345 | B2 * | 2/2015 | Laine | 162/175 |
| 2001/0004869 | A1 | 6/2001 | Cantiani et al. | |
| 2011/0008638 | A1 | 1/2011 | Miyawaki et al. | |
| 2015/0101769 | A1 * | 4/2015 | Laine | D21H 11/18 162/9 |
| 2015/0101770 | A1 * | 4/2015 | Laine | D21H 11/18 162/9 |
| 2015/0144279 | A1 * | 5/2015 | Laine | D21H 11/18 162/9 |

FOREIGN PATENT DOCUMENTS

| | | | |
|---|---|---|---|
| CN | 1335856 | A | 2/2002 |
| EP | 0490425 | A1 | 6/1992 |
| EP | 1936032 | A1 | 6/2008 |
| GB | 2066145 | A | 7/1981 |
| JP | 63203894 | A | 8/1988 |
| JP | H01-246495 | A | 10/1989 |
| JP | 4-185794 | A | 7/1992 |
| JP | 2002-173884 | A | 6/2002 |
| JP | 2009-263849 | A | 11/2009 |
| JP | 2010-513741 | A | 4/2010 |
| RU | 2237768 | C1 | 10/2004 |
| RU | 2336281 | C2 | 10/2008 |
| WO | WO-00/47628 | A2 | 8/2000 |
| WO | WO-01/29308 | A1 | 4/2001 |
| WO | WO-2007/063182 | A2 | 6/2007 |
| WO | WO-2008/076056 | A1 | 6/2008 |
| WO | WO-2009/153225 | A1 | 6/2009 |

OTHER PUBLICATIONS

PCT/ISA/210—International Search Report—Nov. 15, 2010 (Issued in Application No. PCT/FE2010/050350).
PCT/IPEA/409—International Preliminary Report on Patentability—Jun. 10, 2011 (Issued in Application No. PCT/FE2010/050350).
State Intellectual Property Office, P.R. China—First Office Action Issued Nov. 22, 2012 in Counterpart Appln No. 201080018912.1.
EPO Communication—Observations by a Third Party Issued Feb. 8, 2013 in Counterpart Appln No. EP 2425057.
Susanna Ahola et al.; "Cellulose nanofibrils—adsorption with poly(amideamine) epichlorophydrin studied by QCM-D and application as a paper strength additive", Springer Science+Buisness Media B.V., 2007.
Martin A Hubbe et al., "Cellulosic Nanocomposites: A Review", BioResources 3(3), 2008, pp. 929-980.
European Search Report—May 22, 2013—(Issued in Counterpart Application No. 13162757.2.).
F.J. Miskiel et al; Use of High Amylose Corn Starch to Improve the Increase in paper Strength Attained by Addition of Microfibrillated Cellulose; Research Disclosure, Dec. 1999; pp. 1557-1558.
Internet publication; Drilling; Mar. 11, 2010; 2 pages.
K. Mörseburg et al.; "Assessing the combined benefits of clay and nanofibrillated cellulose in layered TMP-based sheets"; Cellulose, vol. 16, pp. 797-806.
Finnish Office Action with Translated Search Report—Mar. 17, 2010 (Issued in counterpart Application No. 20095480).
Notification of Reason for Refusal/ With Translation—Aug. 5, 2014 (Issued in Counterpart Application No. 2012-507792).

(Continued)

*Primary Examiner* — Mark Halpern
(74) *Attorney, Agent, or Firm* — Venable LLP; Eric J. Franklin

(57) ABSTRACT

A method for preparing aqueous furnish to be used in paper or paper board manufacturing. Filler and/or fibers are treated with cationic polyelectrolyte and nanofibrillated cellulose. The strength of the paper and the retention of the fillers in paper can be improved. A furnish prepared by a method, and a paper or a paper board manufactured from the furnish.

1 Claim, 5 Drawing Sheets

(56) References Cited

OTHER PUBLICATIONS

European Patent Office—Communication of Notices of Opposition Registered Letter—May 22, 2014 (Issued in Counterpart Application No. 10719950.7).
European Patent Office—Communication of Notice of Opposition—01—Imerys Minerals Limited—Apr. 25, 2014 (Issued in Counterpart Application No. 10719950.7).
European Patent Office—Communication of Notice of Opposition—02—Dr. Bernd, Aechter—Apr. 25, 2014 (Issued in Counterpart Application No. 10719950.7).
European Patent Office—Communication of Notice of Opposition—03—Stora Enso Oyj—Apr. 25, 2014 (Issued in Counterpart Application No. 10719950.7).
European Patent Office—Communication of Notice of Opposition—04—Holman AB—Apr. 25, 2014 (Issued in Counterpart Application No. 10719950.7).
European Patent Office—Communication of Notice of Opposition—05—Imerys Minerals Limited—Apr. 25, 2014 (Issued in Counterpart Application No. 10719950.7).
Retulainen et al., "Fibre properties as control variables in papermaking?", 1996.
Retulainen et al., "Enhancing strength properties of kraft and CTMP fibre networks", 1993.
Niskanen, "Papermaking Science and Technology—Paper Physics", 1998.
Lindström et al., "On the nature of joint strength in paper—A review of dry and wet strength resins used in paper manufacturing", 2005.
Eriksen et al., "The use of microfibrillated cellulose produced from kraft pulp as strength enhancer in TMP paper", 2008.
Eriksen et al., "Application of polymeric multilayers of starch onto wood fibres to enhance strength properties of paper", Nordic Pulp and Paper Research Journal vol. 20, No. 3, 2005.
Hedborg et al., "Adsorption of cationic starch on a CaCO, filler", 1993.
Holik, "Handbook of Paper and Board", 2006.
Hubbe, "Bonding between cellulosic fibers in the absence and presence of dry-strength agents—a review", 2006.
Laine, What is nanocellulose?, 2008.
Carvalho et al., "A comparative study of two automated techniques for measuring fiber length", 1997.
RL2066/8 Cationic Styrene Butadiene Latex, Aug. 2008.
Resistant starch (Wikipedia), retrieved Apr. 11, 2014.
Wågberg et al., "The Build-Up of Polyelectrolyte Multilayers of Microfibrillated Cellulose and Cationic Polyelectrolytes", 2008.
Salmi et al., "Layer Structures formed by Silica Nanoparticles and Cellulose Nanofibrils with Cationic Polyacrylamide (C-PAM) on Cellulose Surface and their Influence on lnterfactions", 2009.
Nieminen, "Hienonainelajin ja tärkkelyksen vaikutus kuituverkoston ominaisuuksiin", 1995.
Ylönen, "PCC-täyteaineen vaikutus hienopaperin lujuuskäyttäytymiseen nopeassa vetokuormituksessa", 2002.
Gavelin, "Coflocculation of fines and fillar particles" 1985.
Silenius, "Improving the combinations of critical properties and process parameters of printing and writing papers and paperboards by new paper-filling methods", 2002.
Wypych, "Handbook of fillers",2000.
Wågberg, "Polyelectrolyte adsorption on cellulose fibres—a review", 2000.
Subramanian et al., "PCC-cellulose composite fillers", 2007.
Decision Grant With Translation—Aug. 1, 2014 (Issued in Counterpart Russian Application No. 2011148392).

* cited by examiner

METHOD FOR PRODUCING FURNISH, FURNISH AND PAPER

CROSS-REFERENCE TO RELATED APPLICATIONS

This application is a continuation of co-pending application Ser. No. 13/318,246 filed 31 Oct. 2011, which claims priority under 35 U.S.C. §119 to Finnish patent application 20095480 filed 29 Apr. 2009 and was the national phase under 35 U.S.C. §371 of PCT/FI2010/050350 filed 29 Apr. 2010.

FIELD OF THE INVENTION

The present invention relates to a method for preparing aqueous furnish to be used in paper or paper board manufacturing. The invention also relates to furnish prepared by the method according to the invention, and to paper or paper board manufactured from the furnish.

BACKGROUND OF THE INVENTION

For economical reasons, the trend in paper industry is to increase the proportion of filler in paper products and thereby to reduce the use of fibres. In addition to low price and good availability, fillers also increase the printability and optical properties of paper. However, a problem related to the increasing of the filler proportion is that the filler addition leads to a deterioration in the mechanical properties of the paper product. These mechanical properties of paper depend on inter-fibre bonding, and fillers inhibit partly this inter-fibre bonds formation due to their rigidity and poor capability of hydrogen bond formation. Increasing the binding between fibres and fillers is thus essential to improve the strength of filled paper. Furthermore, better affinity between the fibres and the fillers will also lead to a better retention of fillers.

The interactions between fibres and fillers have been widely studied, and many different solutions for improving the inter-fibre bonding have been presented. The loss of the paper strength has been reduced, among other things, by using thinner filler particles. Another solution to this problem is to add starch into the fibre suspension, because the adsorption of starch on fibres increases paper strength by increasing the strength of inter-fibre bonds. Although starch is very cost-effective, it cannot be used in high concentrations because of the problems of significant sticky behaviour of starch on forming wire. Furthermore, the addition of fines in paper is another effective way to compensate for the strength loss which is caused by the presence of the fillers. However, added fines may induce dewatering problems.

As described above, many different solutions have been presented to improve interactions between fibres and fillers in order to enhance the strength of the filled paper. However, there is still a need for a method that makes it possible to use a high content of the filler so that the strength of the final paper product will not decrease and so that the method will not cause any other unwanted effects on the manufacturing process.

SUMMARY OF THE INVENTION

It is an aim of the present invention to provide a novel method for preparing aqueous furnish to be used in paper and paper board manufacturing in such a way that the paper product manufactured from the furnish has a high loading of filler, with good mechanical strength. The aim of the invention is also to provide a novel method for preparing a furnish in order to improve the interactions between fibres and fillers.

The invention also relates to furnish prepared by the method according to the invention, and to paper or paper board manufactured from the furnish prepared by the method according to the invention.

The invention is based on the modification of the fibre and/or filler surfaces in such a way that the fibre-filler bonding will be enhanced, because the poor capability of fillers to form bonds with fibres is greatly responsible for the low retention of fillers and for the loss of mechanical properties of filled paper. In the method according to the invention, at least the filler surface is modified by adsorption of cationic polyelectrolyte and nanofibrillated cellulose (NFC) during the furnish preparation. This modification creates a bilayer of cationic polyelectrolyte and NFC around the fillers, which improves the affinity between fillers and fibres. Also, the fibre surfaces can be treated equally by forming the bilayer of cationic polyelectrolyte and NFC around the fibres.

Filler and/or fibres are treated with cationic polyelectrolyte and nanofibrillated cellulose during the furnish preparation. The modification can be carried out in different ways. The treatment of the filler with cationic polyelectrolyte and NFC can be carried out by mixing the filler with the cationic polyelectrolyte and NFC before adding them to the fibre suspension. Alternatively, the modification of the fibre and filler surfaces can be carried out at the same time in the fibre suspension without separate mixing steps, or the fibre surfaces can be treated with cationic polyelectrolyte and NFC before the addition of the filler to the fibre suspension. It is also possible to treat filler and fibres separately one with cationic polyelectrolyte and other with nanofibrillated cellulose. The way of the modification can be chosen according to the convenience, for example based on the existing paper mill layout.

One alternative way is to modify the filler surfaces by forming cationic polyelectrolyte and NFC bilayer as described above and in parallel, to modify the fibre surfaces by adsorption of cationic polyelectrolyte, because the adsorption of cationic polyelectrolyte on fibres increases the strength of inter-fibre bonds and increases the affinity of the modified filler to the cellulose fibres. Therefore, the modification of filler surface by cationic polyelectrolyte and NFC combined with the modification of fibres by cationic polyelectrolyte enhances significantly the filler-fibre bonding and thus the filler retention and the mechanical properties of the final paper product, particularly in Z-direction.

Any of the conventional cationic polyelectrolytes used in paper manufacturing are suitable for the method according to the invention. Preferably, cationic polyelectrolyte is cationic starch.

In the furnish preparation, at least a part of the filler conventionally used is replaced with the filler containing cationic starch and nanofibrillated cellulose absorbed to the surface of the filler. In addition to the modified filler, the furnish can also contain other fillers, sizing materials and additives as known by a skilled person in the art.

The modification of filler and/or fibre surfaces with cationic polyelectrolyte and nanofibrillated cellulose leads to increased fibre-filler bonding. This increase enhances significantly the retention of fillers and the strengthening effect of the cationic polyelectrolyte. Furthermore, when the strength of paper is increased, the nanofibrillated cellulose is beneficial in maintaining the bulk of the paper. Finally, it can also be mentioned that the strength and retention values of the paper that are achieved with the combination of cationic starch and NFC are similar to those obtained with a quantity of cationic starch not conceivable, because of stickiness problems induced by an addition of such a high amount of starch.

DESCRIPTION OF THE DRAWINGS

The present invention will now be described in more detail with reference to the appended drawings, in which.

DETAILED DESCRIPTION OF THE INVENTION

Figure 1:
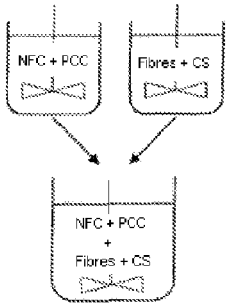
FIG. 1 shows a strategy of mixing different components which are used in the Example 1.

In the method according to the invention, the filler and/or fibre surfaces are modified by adsorption of cationic polyelectrolyte and nanofibrillated cellulose (NFC) during the furnish preparation in order to improve the interaction between fibres and fillers. It has been observed that cationic polyelectrolyte and nanofibrillated cellulose can be absorbed on the surface of fillers and fibres used for paper and paper board manufacture during simple processing suitable for a paper mill process.

The modification of filler and/or fibre surfaces can be carried out by mixing them with cationic polyelectrolyte and nanofibrillated cellulose. Preferably, the filler and fibres are treated first with cationic polyelectrolyte and secondly with nanofibrillated cellulose by adding them to the fibre-filler suspension. Alternatively, the filler is treated with cationic polyelectrolyte and nanofibrillated cellulose before adding it to fibre suspension. Also in this case, the filler is preferably treated first with cationic polyelectrolyte and secondly with nanofibrillated cellulose by adding them to the filler suspension. The fibres can be treated with cationic polyelectrolyte before adding the modified fillers to the fibre suspension in order to increase the strength of inter-fibre bonds.

The term nanofibrillated cellulose refers to a collection of isolated cellulose microfibrils or microfibril bundles derived from cellulose raw material. Nanofibrillated cellulose have typically high aspect ratio: the length might exceed one micrometer while the number-average diameter is typically below 200 nm. The diameter of nanofibril bundles can also be larger but generally less than 5 μm. The smallest nanofibrils are similar to so called elementary fibrils, which are typically 2-12 nm in diameter. The dimensions of the fibrils or fibril bundles are dependent on raw material and disintegration method. The nanofibrillated cellulose may also contain some hemicelluloses; the amount is dependent on the plant source. Mechanical disintegration of nanofibrillated cellulose from cellulose raw material, cellulose pulp, or refined pulp is carried out with suitable equipment such as a refiner, grinder, homogenizer, colloider, friction grinder, ultrasound sonicator, fluidizer such as microfluidizer, macrofluidizer, or fluidizer type homogenizer. Nanofibrillated cellulose can also be directly isolated from certain fermentation processes. The cellulose-producing micro-organism of the present invention may be of the genus *Acetobacter, Agrobacterium, Rhizobium, Pseudomonas* or *Alcaligenes*, preferably of the genus *Acetobacter* and more preferably of the species *Acetobacter xylinum* or *Acetobacter pasteurianus*. Nanofibrillated cellulose can also be any chemically, enzymatically or physically modified derivate of cellulose microfibrils or microfibril bundles. The chemical modification could be based for example on carboxymethylation, oxidation, esterification, or etherification reaction of cellulose molecules. Modification could also be realized by physical adsorption of anionic, cationic, or non-ionic substances or any combination of these on cellulose surface. The described modification can be carries out before, after, or during the production of microfibrillar cellulose.

Nanofibrillated cellulose can also be called nanocellulose, nanofibrillar cellulose, cellulose nanofiber, nano-scale fibrillated cellulose, microfibrillar cellulose, cellulose nanofibrils (CNF) or microfibrillated cellulose (MFC). In addition, nanofibrillated cellulose produces by certain microbes has also various synonymes, for example, bacterial cellulose, microbial cellulose (MC), biocellulose, nata de coco (NDC), or coco de nata. Nanofibrillated cellulose described in this invention is not the same material as so called cellulose whiskers, which are also known as: cellulose nanowhiskers, cellulose nanocrystals, cellulose nanorods, rod-like cellulose microcrystals or cellulose nanowires. In some cases, similar terminology is used for both materials, for example by Kuthcarlapati et al. (Metals Materials and Processes 20(3): 307-314, 2008) where the studied material was called "cellulose nanofiber" although they clearly referred to cellulose nanowhiskers. Typically these materials do not have amorphous segments along the fibrillar structure as nanofibrillated cellulose, which leads to more rigid structure.

The filler can be any filler used in paper manufacturing, e.g. precipitated calcium carbonate (PCC), ground calcium carbonate (GCC), kaolin, talcum or gypsum. Preferably, the filler is precipitated calcium carbonate (PCC).

In the method according to the invention, the filler is added to the furnish in an amount of 1 to 60% by the dry weight of the fibres in the furnish, preferably 20 to 40% by the dry weight of the fibres. The nanofibrillated cellulose is added in an amount of 0.01 to 20% by the dry weight of the fibres in the furnish, preferably 1 to 10%, and most preferably 1 to 3%.

Cationic polyelectrolyte can be any retention or strength polymer used in paper manufacturing, e.g. cationic starch, cationic polyacrylamide (CPAM) or polydimethyldiallyl ammonium chloride (PDADMAC). Also, the combinations of the different polyelectrolytes can be used. Preferably, the cationic polyelectrolyte is cationic starch (CS).

The cationic polyelectrolyte is added in an amount of 0.01 to 5% of dry weight of fibres in the furnish, preferably approximately 2 to 4%.

The furnish prepared by the method according to the invention can be used as such in paper or paper board making. However, the furnish can also contain non-treated fillers and other components, including e.g. conventional auxiliary agents and retention agents. The filler modified with cationic polyelectrolyte and nanofibrillated cellulose can be used in combination with conventional untreated fillers in filled paper grades.

The furnish prepared by the method according to invention is used for manufacturing of a paper or paper board product. In the paper or paper board machine, the furnish is fed into a forming section and water is removed from the furnish by allowing the furnish to drain through a water permeable forming wire, and after that, the paper web thus produced is dried and finished to produce a final paper or paper board product with good mechanical strength properties and a high filler content.

The following examples were carried out to illustrate the present invention. The examples are not intended to limit the scope of the invention.

Example 1

This example was carried out to demonstrate that the method according to the invention clearly increases the filler retention and strength of paper sheets with a high filler content.

The materials used in this experiment were the following:

Fibres Dried hardwood (birch) bleached chemical pulp was used in the experiments.

About 360 g (o.d.) of pulp was soaked overnight in 5 l of water and beaten for 50 minutes at a consistency of 1.6% in a Valley beater (ISO 5264-1) to the Shopper-Riegler (SR) number (ISO 5267-1) of about 42. Afterwards 2 l of water was used to remove the last fibres remaining in the beater and added to the fibre suspension. This suspension was fractionated in a Bauer McNett classifier (SCAN-CM 6:05) using a 200 mesh wire to remove the fines fraction. At this point the SR number was about 18. Finally, the pulp was washed, first by acidic treatment (0.01 M hydrochloric acid) to remove metal ions and afterwards the fibres were converted to sodium form with 1 mM of sodium bicarbonate. After these two treatments, the pulp was washed thoroughly with deionised water.

The fractioning and washing were done in order to prevent possible interference of varying fines content, pH or salts that would hamper interpretation of the results.

Fillers

The filler was commercial scalenohedral precipitated calcium carbonate (PCC). According to the manufacturer, the average particle size of this PCC was 2.3 μm, the brightness 95% and the dry matter content was 19.9%.

Nanofibrillated cellulose (NFC)

Nanofibrillated cellulose was obtained by high pressure homogenisation of fully bleached softwood including an enzymatic pre-treatment step. The principles of this approach have been published in Paakko, et al., Enzymatic hydrolysis combined with mechanical shearing and high pressure homogenization for nanoscale cellulose fibrils and strong gels, Biomacromolecules (8), pp. 1934-1941, 2007. Just before use, NFC-gel (about 1-2% solid content) was diluted with deionised water and disintegrated with Branson Digital Sonifier (Branson Ultrasonics Corporation, Danbury, USA) with an amplitude setting of 25% for 2 minutes.

Cationic Starch

Cationic starch (CS) with a degree of substitution of 0.035 was supplied by Ciba Specialty Chemical, Raisio, Finland. Before use, 2 g (o.d.)/l starch solution was cooked in an autoclave at 120° C. for 20 minutes.

Water

The water used in all the experiments was deionised water.

During the preparation of pulp slurry, 1.63 g (o.d.)/l of fibres were mixed together with starch in a vessel for 15 minutes. In parallel, nanofibrillated cellulose (NFC) was mixed together with PCC for 15 minutes. Afterwards, both contents were poured into the same vessel and mixed for 15 minutes. This mixing strategy is illustrated in FIG. 1.

To the preparation of the different test points (presented in Table 1), four different compositions of pulp slurry were used:

- one reference with fibre dispersion only (reference sample),
- one with fibres and cationic starch (samples CS2.5, CS5 and CS10),
- one with fibres and NFC (samples NFC25 and NFC 50), and
- one with fibres, cationic starch and NFC (samples CS2.5+NFC25 and CS2.5+NFC50).

According to the test points, three different amounts of cationic starch: 25, 50 and 100 mg/g (o.d.) of fibres and two different amounts of NFC: 25 and 50 mg/l (o.d.) were added to the suspensions. In Table 1, sample compositions CS2.5, CS5, CS10 with fibres and cationic starch comprise different amounts of cationic starch as mentioned above. Also, sample compositions NFC25 and NFC 50 with fibres and NFC comprise above mentioned amounts of NFC. Sample CS2.5+NFC25 comprises fibres, 25 mg/g CS and 25 mg/l NFC, and sample CS2.5+NFC50 comprises fibres, 25 mg/g CS and 50 mg/l NFC.

To these four different mixtures various amount of PCC were also added. The amount of the fibres added was 1.63 g in each case.

TABLE 1

Summary of the experiments carried out.

| sample | PCC added (g/g of paper) | NFC added (mg/sheet or mg/l) | NFC (mg/g paper) | CS added (% dry fibres) | CS (mg/g paper) | Ash content (% sheet) |
|---|---|---|---|---|---|---|
| reference | 0 | 0 | 0 | 0 | 0 | 0 |
| | 2.00 | 0 | 0 | 0 | 0 | 25.9 |
| | 3.49 | 0 | 0 | 0 | 0 | 31.7 |
| | 5.97 | 0 | 0 | 0 | 0 | 35.9 |
| CS2.5 | 0 | 0 | 0 | 2.5 | 24 | 0 |
| | 0.70 | 0 | 0 | 2.5 | 19 | 23.2 |
| | 1.71 | 0 | 0 | 2.5 | 15 | 39.2 |
| | 3.68 | 0 | 0 | 2.5 | 12 | 50.5 |
| CS5 | 0.00 | 0 | 0 | 5 | 48 | 0 |
| | 0.58 | 0 | 0 | 5 | 32 | 32.0 |
| | 1.39 | 0 | 0 | 5 | 23 | 52.7 |
| CS10 | 0.00 | 0 | 0 | 10 | 91 | 0 |
| | 0.49 | 0 | 0 | 10 | 55 | 39.5 |
| | 1.25 | 0 | 0 | 10 | 40 | 55.7 |
| NFC25 | 0 | 25 | 15 | 0 | 0 | 0 |
| | 0.89 | 25 | 11 | 0 | 0 | 27.1 |
| | 1.62 | 25 | 1 | 0 | 0 | 33.6 |
| | 2.67 | 25 | 9 | 0 | 0 | 38.5 |
| NFC50 | 0 | 50 | 30 | 0 | 0 | 0 |
| | 0.68 | 50 | 22 | 0 | 0 | 25.6 |
| | 1.48 | 50 | 17 | 0 | 0 | 41.7 |
| | 4.27 | 50 | 17 | 0 | 0 | 42.3 |
| CS2.5 + NFC25 | 0 | 25 | 15 | 2.5 | 24 | 0 |
| | 0.28 | 25 | 12 | 2.5 | 20 | 17.4 |
| | 0.87 | 25 | 8 | 2.5 | 13 | 45.5 |
| | 1.78 | 25 | 7 | 2.5 | 11 | 53.4 |
| CS2.5 + NFC50 | 0 | 50 | 29 | 2.5 | 24 | 0 |
| | 0.26 | 50 | 23 | 2.5 | 19 | 20.5 |
| | 0.64 | 50 | 16 | 2.5 | 13 | 44.2 |
| | 1.00 | 50 | 14 | 2.5 | 11 | 51.7 |

After furnish preparation, handsheets were formed. Sheets were formed in a laboratory sheet former, Lorentzen & Wettre AB, Sweden (ISO 5269-1) with a 100 mesh wire. The grammage of sheets was adjusted to about 60 g/m$^2$ by dilution of the suspension when necessary. The sheets were wet pressed under 4.2 bar for 4 minutes and dried in a frame to avoid shrinkage during drying (105° C. for 3 minutes). The samples were conditioned according to the standard SCAN_P 2:75.

All the sheet properties were measured according to SCAN or ISO standards. The grammage (ISO 536:1995(E)), the thickness and the bulk were determined with Lorentzen & Wettre micrometer (ISO 534:2005(E)). The tensile strength, the stretch and the stiffness were determined with Alwetron TH1 (ISO 1924-2:1994(E)). The tear index was measured with Lorentzen & Wettre tearing tester (SE009 Elmendorf) (SCAN-P 11:73), and optical properties were determined by Lorentzen & WettreElrepho. The ash content was measured according to the standard ISO 1762:2001(E) to determine the amount of retained fillers in paper sheets.

The main objective of the above described experiments was to evaluate the effect of the modification of filler surface by NFC and CS on the fibre-filler bonding. Several strength properties as well as filler retention were measured for handsheets obtained after various treatments.

Figure 2:
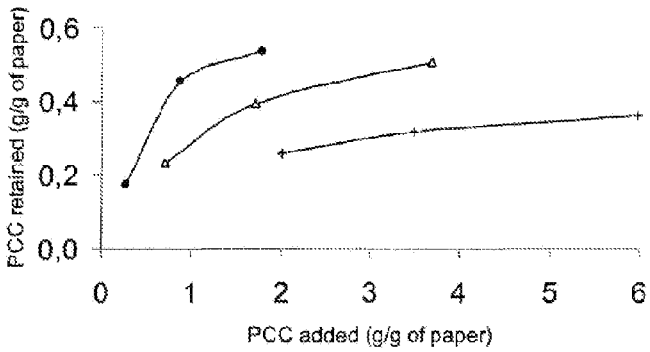
FIG. 2 shows the amount of PCC retained in handsheets as a function of the added amount of PCC (Example 1)

FIG. 2 shows the PCC retained in handsheets as a function of the added amount of PCC. The curves illustrate results obtained from a sheet containing no additives (reference: +) and from sheets prepared either with cationic starch alone (CS2.5: Δ) or with a mixture of cationic starch and NFC (CS2.5+NFC25: ●). The PCC retained is obtained from the value of ash content at 525° C. As shown in FIG. 2, the combination of cationic starch and NFC (sample CS2.5+ NFC25) allows a very great improvement of PCC retention. If we look at 0.36 g/g of paper of PCC retained (equivalent to 35% of filler content), the amount of PCC added is about 10 times less than with combination of cationic starch and NFC than with reference. The retention is also significantly higher (more than twice) than that obtained by addition of starch alone.

Figure 3:
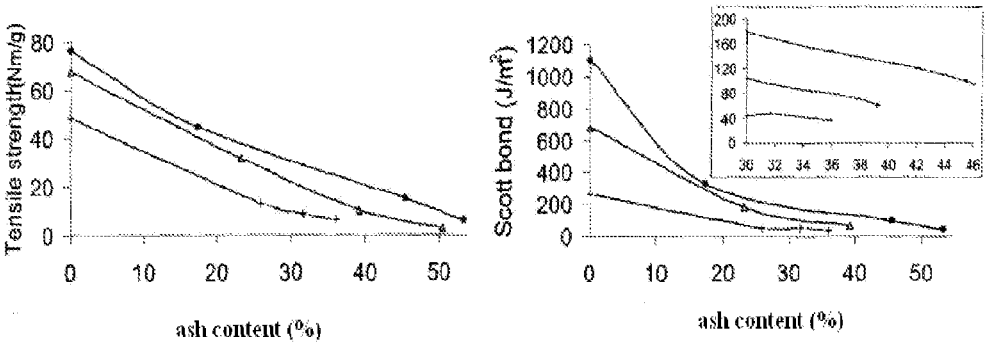
FIG. 3 shows the tensile strength and Scott bond of handsheets as a function of filler content (Example 1)

FIG. 3 shows the tensile strength and Scott bond of handsheets as a function of filler content. The curves illustrate results obtained from sheet containing no additives (reference: +) and from sheets prepared either with cationic starch alone (CS2.5: Δ) or with a mixture of cationic starch and NFC (CS2.5+NFC25: ●). The combination of cationic starch and NFC (sample CS2.5+NFC25) leads to an increase in strength properties, particularly in Z-direction, as shown by Scott bond results.

Figure 4:
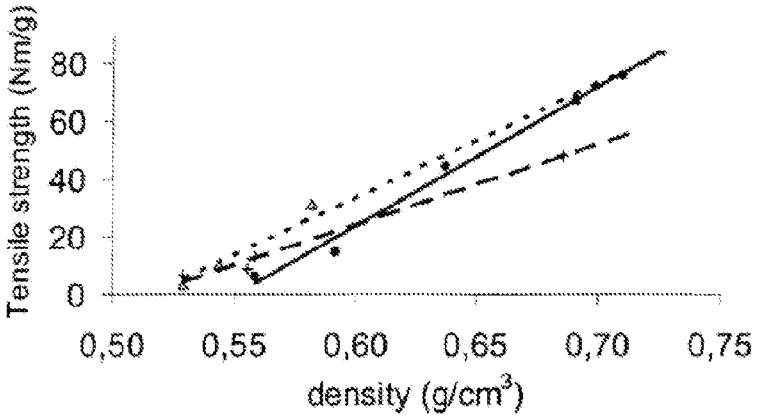
FIG. 4 shows the tensile strength of handsheets as a function of the density of handsheets (Example 1)

The strength of paper is usually proportional to the sheet density. The enhancement of the strength properties also increases the density of the sheet. It would be optimal if stronger paper could be obtained without a significant increase in density. FIG. 4 shows the tensile strength of handsheets as a function the density. In FIG. 4, the curves also illustrate results obtained from sheet containing no additives (reference: +) and from sheets prepared either with cationic starch alone (CS2.5: Δ) or with a mixture of cationic starch and NFC (CS2.5+NFC25: ●). From FIG. 4, it can be observed that the combination of cationic starch and NFC (sample CS2.5+ NFC25) has the steepest slope. NFC is thus beneficial in maintaining the bulk.

Figure 5:
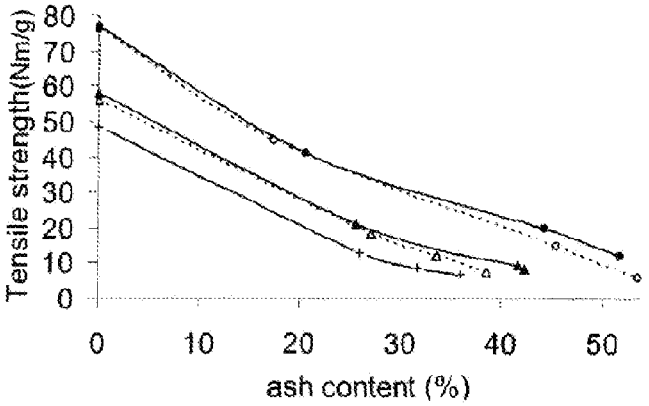
FIG. 5 shows the tensile strength of handsheets as a function of filler content (Example 1)

In order to determine the influence of the NFC amount on the strength properties, the added amount of NFC was varied (see FIG. 5). NFC was either mixed in the pulp together with cationic starch or added alone as such. In FIG. 5, the curves illustrate results obtained from sheet containing no additives (reference: +) and from sheets prepared either with two different amounts of NFC (NFC25: Δ and dotted line, NFC50: ▲) or with a mixture of cationic starch and different amounts of NFC (CS2.5+NFC25: o and dotted line, CS2.5+ NFC50: ●). When NFC is used alone, a slight improvement of tensile strength can be seen. However, the value is much lower than that obtained with the combination of cationic starch and NFC.

Figure 6:
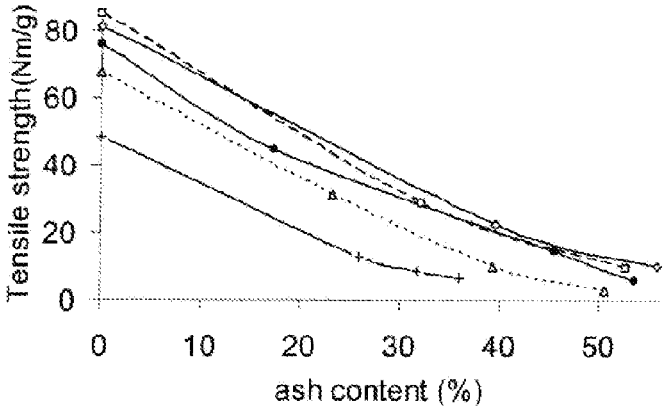
FIG. 6 shows the tensile strength of handsheets as a function of filler content (Example 1)

On the other hand, in order to compare the effect of cationic starch either alone or combined with NFC, on paper strength, three different amounts of starch were used. These results are illustrated in FIG. 6. In FIG. 6, the curves illustrate results obtained from sheet containing no additives (reference: +) and from sheets prepared either with three different amounts of cationic starch (CS2.5: Δ and dotted line, CS5: □ and dashed line, and CS10: ◇) or with a mixture of cationic starch and NFC (CS2.5+NFC25: ●). Very high amounts of cationic starch are needed in order to obtain a similar sheet strength to using the combination of cationic starch and NFC proposed here. Thus, the combination of the cationic starch and nanofibrillated cellulose is a preferable combination for improving the tensile strength and Z-directional strength of the paper product.

Example 2

The aim of this example was to test different strategies of mixing filler and fibres with cationic starch and nanofibrillated cellulose in order to determine their influence on paper strength. Another aim was to illustrate the effect of combining NFC and cationic starch for improving the strength of filled paper in situations where fines are present.

The materials used in the experiments are the following:

Fibres

Dried hardwood (birch) bleached chemical pulp was also used in this example. About 360 g pulp was soaked overnight in 5 l of water and beaten for 50 minutes at a consistency of 1.6% in a Valley beater (ISO 5264-1) to the Shopper-Riegler (SR) number (ISO 5267-1) of about 42. Afterwards, 2 l of water was used to rinse the beater and added to the fibre suspension. Finally, the pulp was washed, first by acidic treatment (0.01 M hydrochloric acid) to remove metal ions, and afterwards, the fibres were converted to sodium form with 1 mM of sodium bicarbonate. After these two treatments, the pulp was thoroughly washed with deionized water.

The difference to the fibres used in Example 1 is that fines were not removed in this Example.

Nanofibrillated Cellulose (NFC)

Never dried hard wood was disintegrated using a Masuko supermass colloider with 200 μm gap between the stones at 3% consistency. The NFC used for paper sheets was obtained after five passes through the colloider.

The nanofibril gel was delivered at a dry content of 2%. Just before use, NFC was diluted with deionized water and dispersed with Branson Digital Sonifier (Branson Ultrasonics Corporation, Danbury, USA) with an amplitude setting of 25% for 2 minutes.

Cationic Starch

Cationic starch (CS) with a degree of substitution of 0.035 (Raisamyl 50021) was supplied by Ciba Specialty Chemical, Raisio, Finland. Before use, 2 g (o.d.)/l starch solution was cooked in an autoclave at 120° C. for 20 minutes.

Fillers

Commercial scalenohedral precipitated calcium carbonate (PCC). According to the manufacturer, the average particle size of this PCC was 2.3 μm, the brightness 95% and the dry matter content 19.9%.

In this example, seven different mixing strategies were chosen in order to prepare the pulp slurry (FIGS. 7*a* to 7*g*):

Strategy 1 (FIG. 7*a*): Fibres were put in suspension in a vessel with deionized water. In parallel, cationic starch was diluted with deionized water in a vessel and mixed together with PCC for 15 minutes. Afterwards, these premixed suspensions were poured into a vessel and mixed for 15 minutes.

Strategy 2 (FIG. 7*b*): Fibres were put in suspension in a vessel with deionized water. In parallel, cationic starch was diluted with deionized water in a vessel and mixed together with PCC for 15 minutes. Afterwards, NFC was added to this suspension and all was mixed again for 15 minutes. Finally, both contents were poured into a vessel and mixed for 15 minutes.

Strategy 3 (FIG. 7*c*): Fibres were put in suspension in a vessel with deionized water. In parallel, cationic starch (CS) was diluted with deionized water in a vessel and mixed together with NFC and PCC for 15 minutes (added simultaneously into the vessel). Afterwards, both contents were poured into a vessel and mixed for 15 minutes.

Strategy 4 (FIG. 7*d*): Fibres were put in suspension in a vessel with deionized water. Afterwards, PCC, cationic starch and NFC were added successively to the fibre suspension and mixed for 15 minutes.

Strategy 5 (FIG. 7*e*): this strategy is similar to strategy 3, but this time the total amount of starch is divided equally between the fibre suspension vessel and the NFC and PCC one.

Strategy 6 (FIG. 7*f*): Fibres were put in suspension with deionized water in a vessel and mixed together with starch for 15 minutes. In parallel, NFC was put in suspension with deionized water in a vessel and mixed together with PCC for 15 minutes. Afterwards, both contents were poured into a vessel and mixed for 15 minutes.

Strategy 7 (FIG. 7*g*): Fibres were put in suspension with deionized water in a vessel and mixed together with PCC for 15 minutes. This is used as Reference sample.

To perform furnish of these seven strategies, 1.63 g/l of fibres were used. 20 or 40 mg of cationic starch per g of fibres and two different amounts of NFC: 15 and 30 mg/g of fibres were used. In all steps, the pH of the slurry was adjusted to about 9 with a sodium bicarbonate buffer solution, and the ionic strength was measured. To be able to compare results from paper testing, the furnish was further diluted with water to obtain a paper sheet grammage between 55 and 65 g/m$^2$.

After the furnish preparation, handsheets were formed from different furnishes as in the Example 1. The sheet properties were measured using the same methods as presented in Example 1.

Figure 8A:
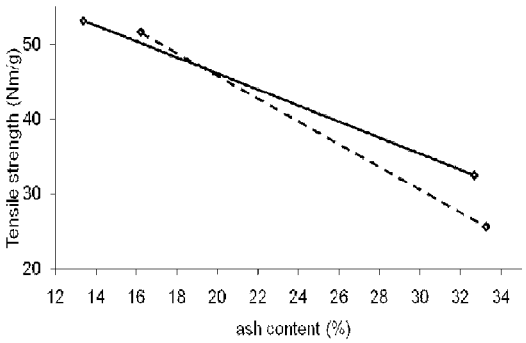
FIGS. 8*a* and 8*b* show the tensile strength of the handsheets as a function of filler content (example 2)
Figure 8B:
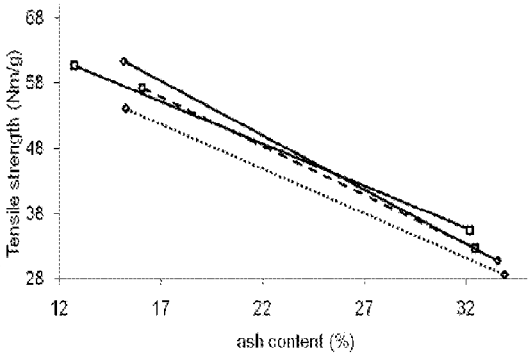

The purpose of the two first strategies, was to determine the optimal amounts of cationic starch and NFC. FIGS. 8*a* and 8*b* show tensile strength of the handsheets as a function of filler content. The curves of FIG. 8*a* illustrate results obtained from sheets prepared with two different content of cationic starch: 2% (dashed line) and 4% (continuous line). The curves of FIG. 8*b* illustrate results obtained from sheets prepared with two different contents of cationic starch and NFC: 2% CS and 15% NFC (◇ and dotted line), 4% CS and 15% NFC (◇ and continuous line), 2% CS and 30% NFC (□ and dashed line), 4% CS and 30% NFC (□ and continuous line). The lines in these figures are only drawn to guide the eye and do not illustrate the actual trend. The increase of cationic starch content does not give significant improvement of the tensile strength. Furthermore, too high starch content may cause problems in the papermaking process, such as stickiness, the lower starch content is thus chosen for the other experiments. The same conclusion can be made for the NFC content, indeed, a higher amount of NFC does not further increase the tensile strength and the content chosen for further experiments was hence the lowest one.

Figure 9:
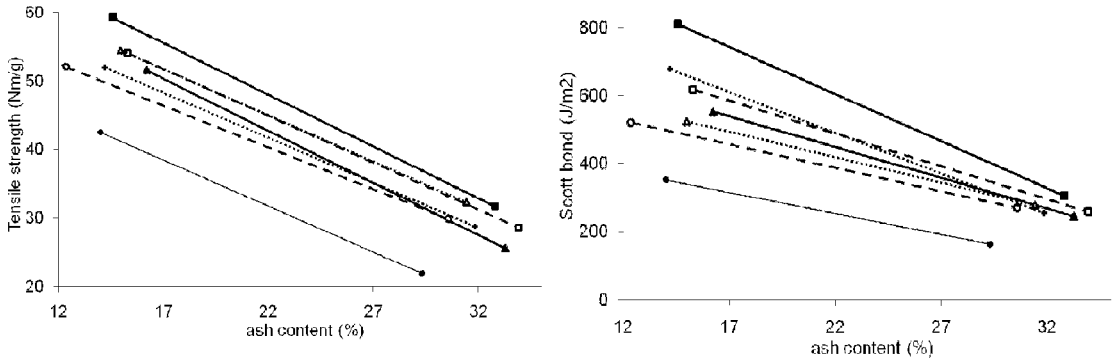
FIG. 9 shows the tensile strength and Scott bond of the handsheets as a function of filler content (Example 2).

The tensile strength and Scott bond obtained with the different mixing strategies are summarized in FIG. 9. FIG. 9 shows tensile strength and Scott bond of the handsheets as function of filler content. The curves illustrate results obtained from sheets prepared with starch alone i.e. strategy 1 (▲ and continuous line), the strategy 2 (□ and dashed line), the strategy 3 (Δ and dotted line), the strategy 4 (■ and continuous line), the strategy 5 (+ and dotted line), the strategy 6 (○ and dashed line) and the reference i.e. strategy 7 (● and continuous line). The changes in tensile strength between the two filler contents are obviously not following a straight line but these lines have been drawn in order to see the trend of change more easily.

Figure 7A:
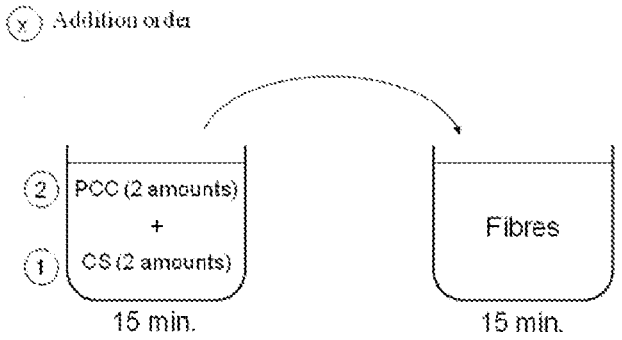
FIGS. 7*a* to 7*g* show strategies of mixing different components which are used in Example 2.
Figure 7B:
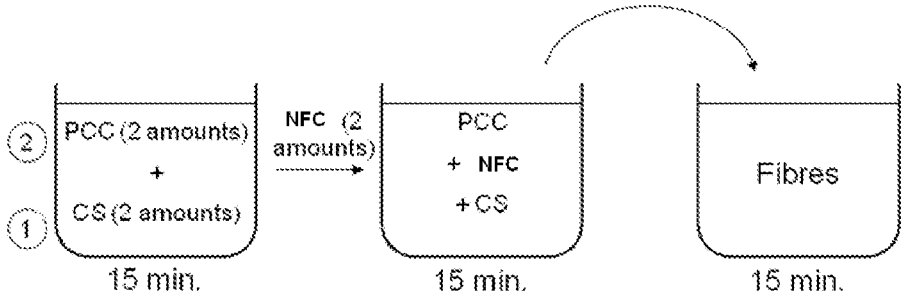
Figure 7C:
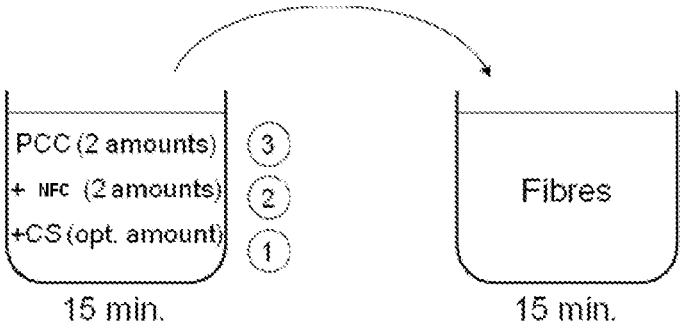
Figure 7D:
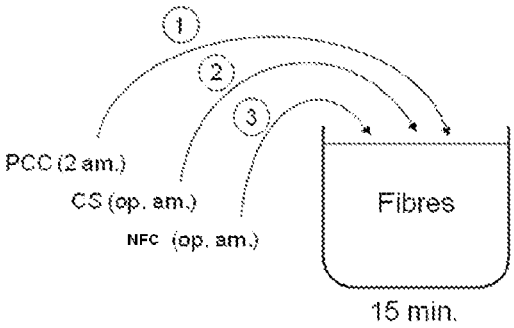
Figure 7E:
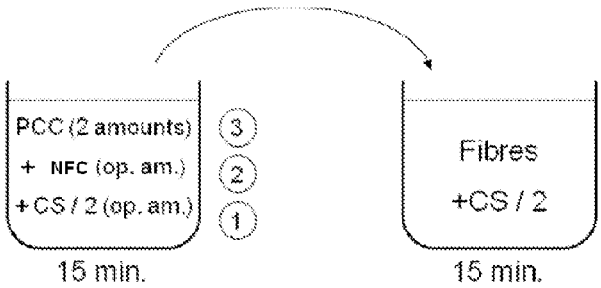
Figure 7F:
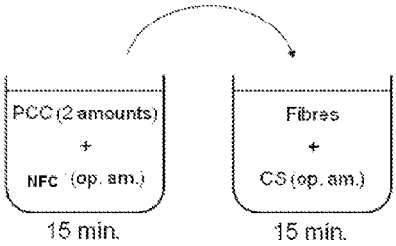
Figure 7G:
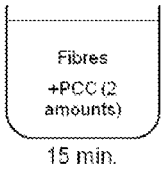

The strength properties obtained with the strategy 4 presented in FIG. 7*d* (mixing fibres and fillers and then adding first CS and then NFC) stands out from the other strategies by its improvement, indeed, if we compare with cationic starch alone for 30% filler content, the tensile strength is increased by 17% and the Scott bond by 26%.

Another efficient way is to treat the fillers with first CS and then NFC (forming a bilayer on the filler surface) and then to add these modified filler particles to the fibre suspension (strategy 2 presented in FIG. 7*b*). In this case the fibres may be unmodified or modified with CS.

Also other strategies increase the strength of the paper sheets but the most efficient way is to form a bilayer of CS and NFC on at least the filler surface but preferably also the fibre surface.

The invention claimed is:

1. A method for preparing a paper or paper board manufactured from aqueous furnish to be used in the paper or paper board manufacturing, the method comprising:

adding at least a filler to a fiber suspension to make a fiber-filler suspension; and treating the filler and the fiber with cationic polyelectrolyte and nanofibrillated cellulose, wherein the filler and the fiber is treated first with cationic polyelectrolyte and second with nanofibrillated cellulose by adding first the cationic polyelectrolyte and then the nanofibrillated cellulose to the fiber-filler suspension to prepare the aqueous furnish; and manufacturing the paper or paper board from the aqueous furnish.

* * * * *